US009051686B2

(12) United States Patent
Trani et al.

(10) Patent No.: US 9,051,686 B2
(45) Date of Patent: Jun. 9, 2015

(54) METHOD FOR MODIFYING THE PHYSICAL AND/OR CHEMICAL CHARACTERISTICS OF A FIBROUS BAND AND APPARATUS FOR CARRYING OUT THE METHOD

(71) Applicants: Giorgio Trani, Venice (IT); Marion Sterner, Venice (IT)

(72) Inventors: Giorgio Trani, Venice (IT); Marion Sterner, Venice (IT)

(73) Assignee: Giorgio Trani, Venice (IT)

( * ) Notice: Subject to any disclaimer, the term of this patent is extended or adjusted under 35 U.S.C. 154(b) by 0 days.

(21) Appl. No.: 14/351,558

(22) PCT Filed: Oct. 25, 2012

(86) PCT No.: PCT/IB2012/002160
§ 371 (c)(1),
(2) Date: Apr. 12, 2014

(87) PCT Pub. No.: WO2013/061147
PCT Pub. Date: May 2, 2013

(65) Prior Publication Data

US 2014/0262096 A1 Sep. 18, 2014

(30) Foreign Application Priority Data

Oct. 27, 2011 (IT) ..... VE2011A0071

(51) Int. Cl.
*D21H 27/02* (2006.01)
*B31F 1/16* (2006.01)
*B31F 1/18* (2006.01)
*D21H 23/24* (2006.01)

(52) U.S. Cl.
CPC .. *D21H 5/02* (2013.01); *B31F 1/16* (2013.01); *B31F 1/18* (2013.01); *D21H 23/24* (2013.01); *D21H 5/06* (2013.01)

(58) Field of Classification Search
USPC ..... 162/217, 361, 111, 197, 205, 296, 271, 162/358.1, 368, 363, 397; 26/18.6
See application file for complete search history.

(56) References Cited

U.S. PATENT DOCUMENTS

| | | | | |
|---|---|---|---|---|
| 1,643,147 | A * | 9/1927 | Angier | 162/111 |
| 2,535,734 | A | 12/1950 | Lage | |
| 3,146,159 | A * | 8/1964 | Muggleton | 162/184 |
| 3,471,363 | A | 10/1969 | Schmidt | |
| 3,586,602 | A * | 6/1971 | Schmidt | 162/359.1 |

FOREIGN PATENT DOCUMENTS

| | | |
|---|---|---|
| WO | 2010001564 | 2/2010 |
| WO | 2011151705 | 12/2011 |

* cited by examiner

*Primary Examiner* — Jacob Thomas Minskey
(74) *Attorney, Agent, or Firm* — Themis Law

(57) ABSTRACT

A method for modifying the physical and/or chemical characteristics of a web of paper material includes the steps of causing a web of paper material, having a dry content between 1% and 90%, to adhere to an endless conveyor belt of elastic material, subjecting the conveyor belt and the web to at least one localized dimensional variation, and introducing at least one additive between the fibers of the web while adhering to the belt before or during the localized dimensional variation.

9 Claims, 6 Drawing Sheets

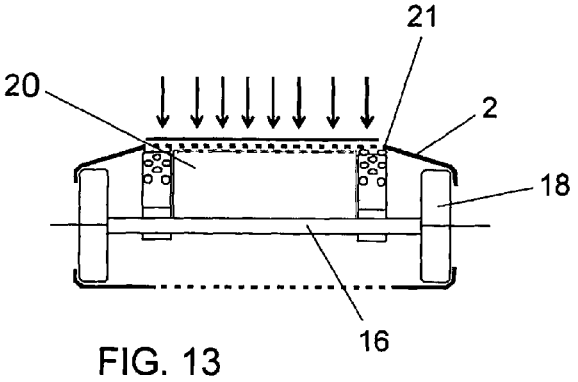
FIG. 13
FIG. 14
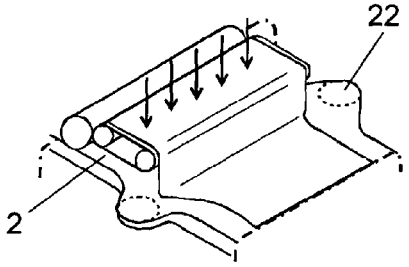
FIG. 15
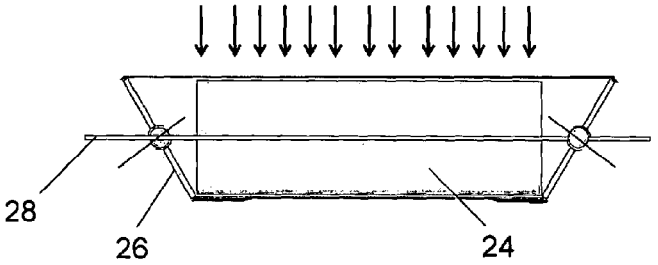
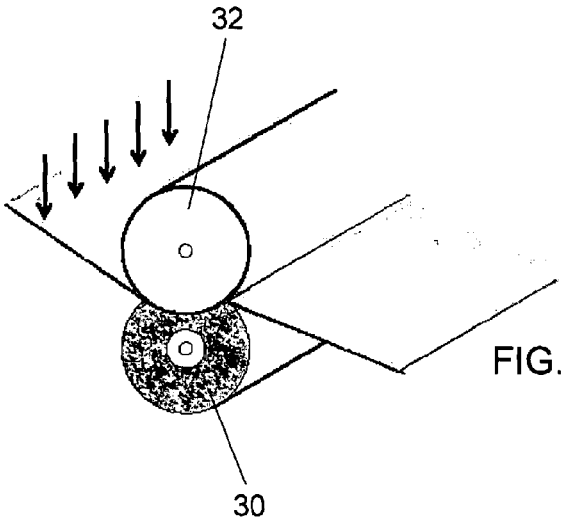
FIG. 18

METHOD FOR MODIFYING THE PHYSICAL AND/OR CHEMICAL CHARACTERISTICS OF A FIBROUS BAND AND APPARATUS FOR CARRYING OUT THE METHOD

FIELD OF THE INVENTION

The present invention relates to a method for modifying the physical and/or chemical characteristics of a fibrous web, and an apparatus for implementing the method.

BACKGROUND OF THE INVENTION

Production methods for fibrous material are known, in particular for paper webs or cellulose sheets. They generally consist of pouring a mix of fibrous material and water onto an endless conveyor belt in movement. Here the mix is progressively deprived of its water content and subjected to a series of traditional processes which finally lead to the obtaining of a paper web or, in more general terms, to the obtaining of a web of fibrous material, to be then wound into rolls for subsequent uses.

The production of fibrous webs, in particular papers of the most varied type, requires the use of many types of chemical products as additives to give the different paper types particular properties, or to facilitate the process.

These products are either added directly to the initial fiber suspension (to the cellulose pulp in the case of paper) or are applied onto the surface of the fibrous web under formation by methods known to the expert of the art.

In the first case, part of the additives is lost during the initial fiber draining stage on the flat table, to create problems of recovery and disposal of the liquid effluent, and of obtaining the correct targeted concentration of added product relative to the fibers.

In the second case, penetration of the additives into the centre of the sheet becomes difficult and there is greater lack of uniformity along its thickness.

SUMMARY OF THE INVENTION

An object of the present invention is to improve the effectiveness of additive addition to said web.

Another object of the present invention is to reduce energy consumption in the additive addition process for said web.

Another object of the present invention is to optimize the consumption of chemical products for modifying the characteristics of said web, including with products not used traditionally in the paper manufacturing industry.

These and other objects which will be apparent from the ensuing description are attained, according to the invention, by a method for modifying the physical and/or chemical characteristics of a fibrous web as described hereinafter.

The invention also comprises an apparatus for implementing the method as also described hereinafter.

BRIEF DESCRIPTION OF THE DRAWINGS

The present invention is further clarified hereinafter with reference to the accompanying drawings, in which:

FIGS. 13, 14, 15 are schematic views of belt stretching apparatuses, FIG. 18 shows schematically two rollers for causing longitudinal stretching.

DETAILED DESCRIPTION OF EMBODIMENTS OF THE INVENTION

As can be seen from the figures, the method according to the invention starts from a fibrous material web 2 having a dry content between 1% and 90% and hence a moisture content between 10% and 99%.

This fibrous material web 2, which can also be coupled to a suitably heated polymer film, is deposited on a conveyor belt 4 made of elastic material and having at least one portion subjected to transverse extension by any mechanical action, consisting for example of a transverse traction at its edges or in proximity thereto, or a forced removal from the sliding plane of a portion thereof retained at its edges.

Independently of the method by which the conveyor belt 4 is transversely stretched, the fibrous web 2 can be brought into contact with it either before or after the stretching.

In the first case, if before this stretching begins or before it is completed, the fibrous web 2 is deposited on the belt and which because of its high water content is in a pliable state, as the conveyor belt widens it also drags the fibrous web while widening. Adhesion can be promoted by vacuum. When the elastic belt is released it returns to its original dimensions, to drag and recompact the fibrous web adhering to it and modify the weave of the fibers and hence the morphology of the fibrous web to better incorporate the additives.

In the second case the fibrous web 2 is brought into contact with the elastic belt 4 which has already been transversely stretched. Said belt is then released and returns to its original dimensions, to drag and recompact the pliable fibrous web adhering to it. The elastic belt is then again transversely stretched, dragging with it the fibrous web still adhering to it. In both these two cases, at least one additive is added to the fibrous web either before or during the described dimensional variation.

In the case of deformation and subsequent elastic return, the deformation can be utilized to cause the additive to be absorbed. Obviously in this case the elastic return is essential and the additive addition must preferably take place at maximum stretching.

Figure 1:
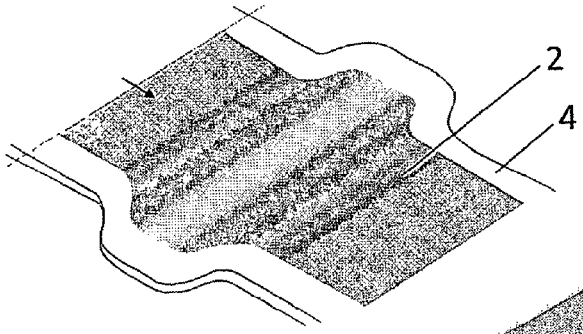
FIG. 1 shows schematically a portion of elastic conveyor belt and of a fibrous web subjected to transverse extension and returned to their original configuration.

FIG. 1 shows an elastic belt 4 with the fibrous web 2 adhering to it, subjected to transverse stretching as the result of application of traction stresses along its edges, followed by release; between this stretching and release, the fibrous web is subjected to drying.

Figure 2:
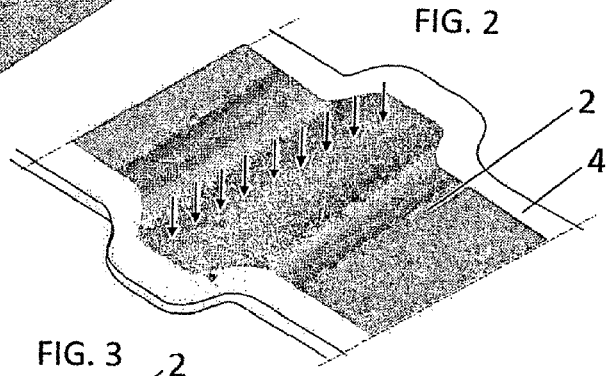
FIG. 2 shows schematically the additive addition stage.

FIG. 2 shows an elastic belt 4 with the fibrous web 2 adhering to it, subjected to transverse stretching as the result of the application of traction stresses along its edges, followed by release; between this stretching release, the fibrous web is subjected to additive addition.

Figure 3:
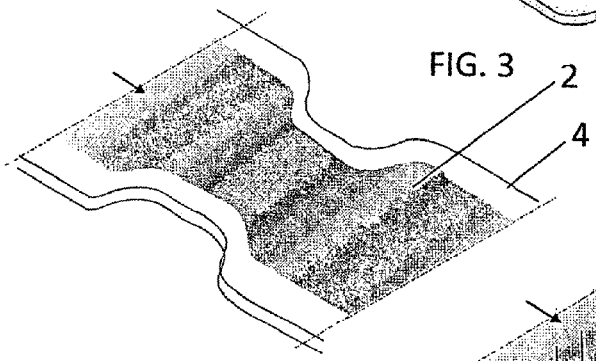
FIG. 3 shows schematically a portion of elastic conveyor belt with fibrous web subjected to stretching and released, then again stretched.

FIG. 3 shows an elastic belt 4 already transversely stretched as the result of application of traction stresses along its edges with the fibrous web 2 adhering to it, then subjected to release and to subsequent stretching; between this release and the second stretching, the fibrous web is subjected to drying.

Figure 4:
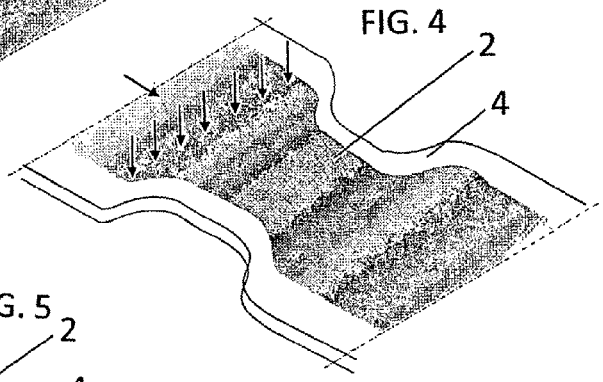
FIG. 4 shows schematically the additive addition stage.

FIG. 4 shows an elastic belt 4 already transversely stretched as the result of application of traction stresses along its edges with the fibrous web 2 adhering to it, then subjected to release and to subsequent stretching; before this release the fibrous web is subjected to additive addition.

Figure 5:
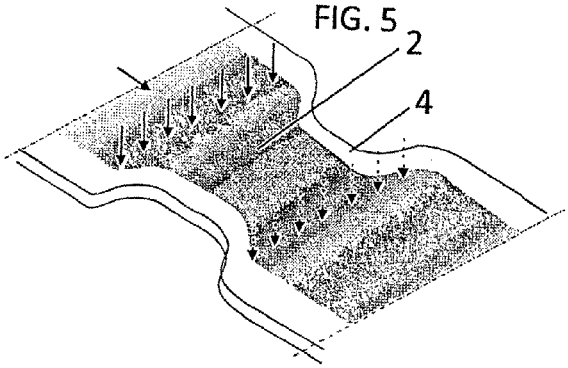
FIG. 5 shows schematically a portion of elastic conveyor belt with fibrous web subjected to two additive addition stages.

FIG. 5 shows an elastic belt 4 already transversely stretched as the result of application of traction stresses along its edges with the fibrous web 2 adhering to it, then subjected to release and to subsequent stretching; both before the release and before the second stretching the fibrous web is subjected to additive addition.

Figure 6:
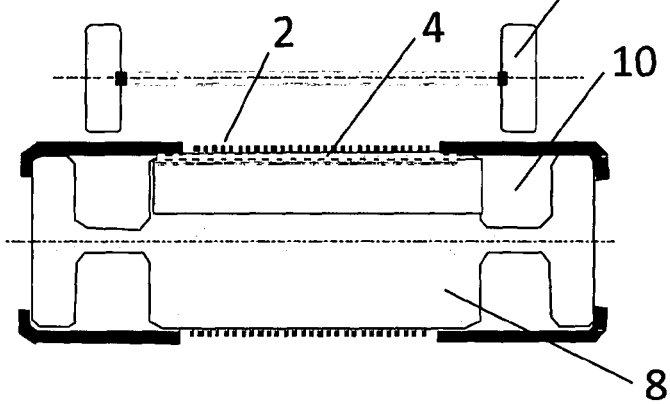
FIG. 6 is a schematic front sectional view of an elastic belt in the form of a first embodiment of an elastic sleeve wrapped about a roller.
Figure 7:
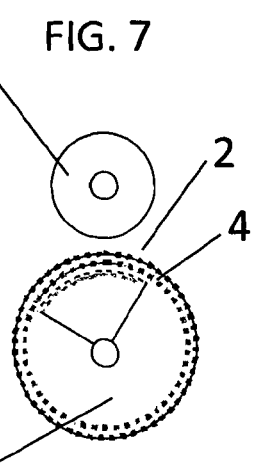
FIG. 7 shows the same embodiment in lateral section.

FIGS. 6 and 7 show an elastic belt 4 consisting of a tubular sleeve 4 wrapped about a rigid roller 8 provided with circumferential cavities 10 formed in said roller n proximity to its two ends.

Figure 8:
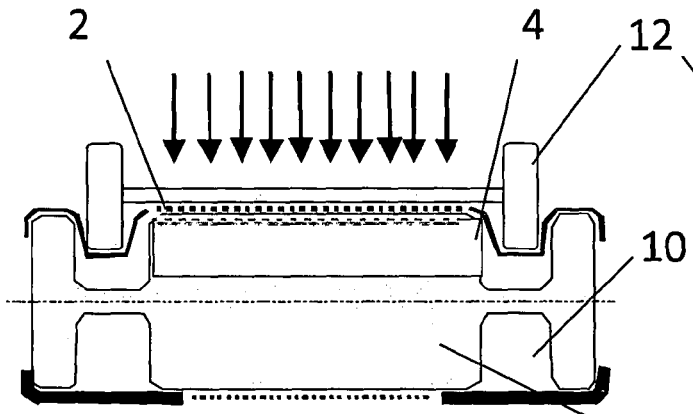
FIG. 8 shows in the same view as FIG. 6 a sleeve subjected to localized stretching and additive addition to the fibrous web adhering to it.
Figure 9:
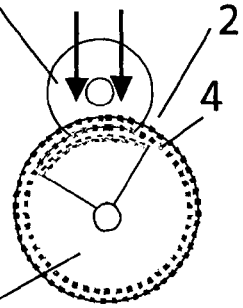
FIG. 9 shows it in lateral view.
Figure 10:
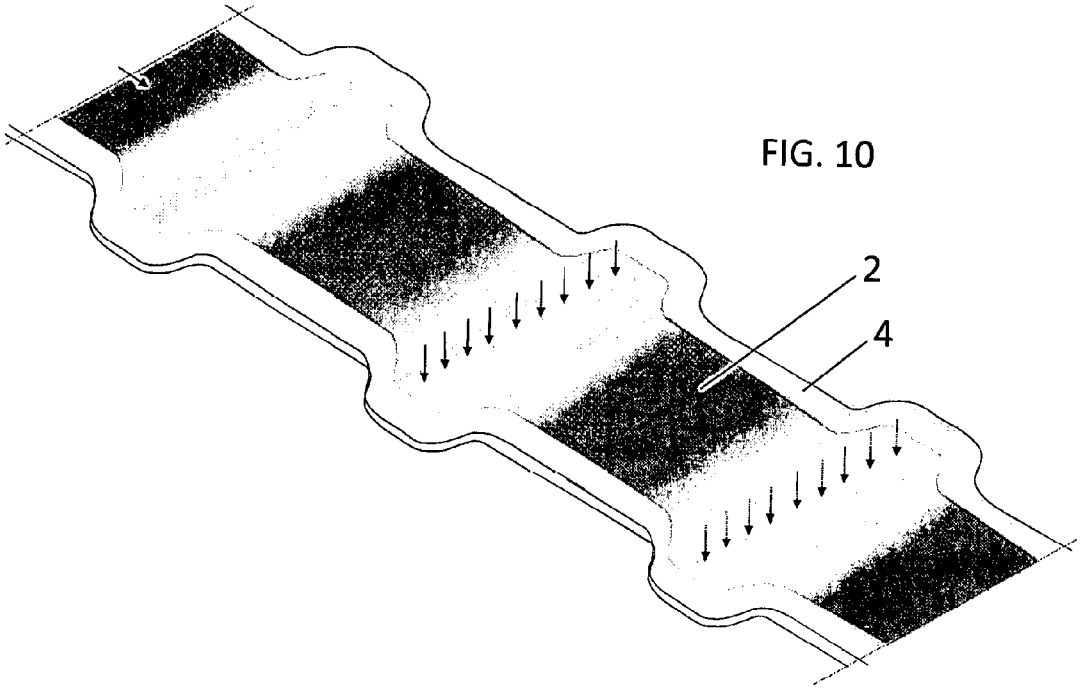
FIG. 10 shows schematically a portion of elastic conveyor belt on which a continuous fibrous web is disposed subjected to successive additive additions.
Figure 11:
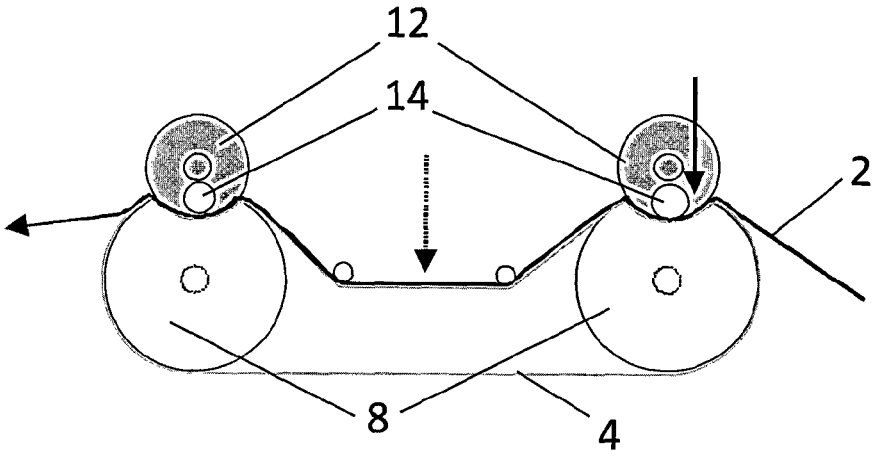
FIG. 11 is a schematic lateral section through a second embodiment of the elastic belt.

In FIGS. 8 and 9 said elastic belt 4 is subjected to transverse stretching as the result of the temporary forced introduction of the belt into the circumferential cavities 10. This temporary forced introduction can be advantageously caused by interference by a pair of introduction rollers 12, which partly enter said circumferential cavities 10. In particular, a product for modifying the web characteristics is added to the fibrous web 2 between the transverse stretching and the release.

At the moment of transverse stretching, the elastic belt undergoes compaction in the longitudinal direction, due to the simultaneous longitudinal shortening of the elastic belt, if this has a normal Poisson deformation coefficient (for example around 0.5). However the simultaneous longitudinal compaction of the belt 4 can be prevented if this is filled with fibers disposed longitudinally and resistant to axial compression (for example steel, Kevlar, carbon), or if it is made from a material having a Poisson coefficient ideally close to zero.

The elastic conveyor belt can consist of one or more layers of possibly expanded elastomer, or of single or multiple fabric formed of threads which may be elastic, or non-elastic but woven in accordance with an elastic weave, or finally of a composite layer formed from the preceding. It can also be permeable to fluids and contain a sponge layer able to absorb and/or release liquids. Finally, the elastic belt can constitute the belt of the so-called flat table, which in a traditional paper machine receives the mix originating from the head box. In this respect, the web 2 of pliable material can originate directly from the head box of any paper processing machine or can be obtained from an already formed paper web already subjected to wetting, and if a mixed material web or a non-woven fabric or a film of only nanocellulose is to be obtained it can consist of cellulose fibers and/or cellulose nanofibers.

To improve adhesion between the web 2 and the elastic surface of the conveyor belt 4, said surface can be modified such as to present high affinity for cellulose. Possible modifications are for example:

using a mixture of elastic material (rubber) and cellulose (fibers, microcrystals and/or nanofibers) for forming the elastic conveyor belt 4, covering the elastic belt with a coating formed from cellulose (for example microcrystalline fibers and/or nanofibers) and a binding agent (e.g. lactose) or an adhesion promoter (silicates, titanates), covering the elastic belt with a coating formed from a rubber latex of low glass transition temperature, covering the elastic belt with formulations typically used for increasing adhesion of the fibrous web to the yankee cylinder used in the production of tissue paper, forming the elastic belt with elasticized fabric formed partially of cotton fibers, covering the elastic belt with microhooks.

In the case of excessive adhesion, to detach the fibrous web 2 from the elastic surface a blade of air or water vapour or possibly a doctor blade can be used. If the elastic belt 4 is permeable to fluids, air can be blown therethrough to detach the fibrous web 2.

The widening caused also widens the pores of the fibrous web and makes the already formed surface layers more permeable, making it easier and less costly to dry the web intermediate layer. Said drying can take place by removing water from the fibrous web by applying pressure or vacuum or heat to said web, or a combination of the preceding simultaneously or in succession. During the local extension of the fibrous web or before or after this extension, various additives (normally used either in the mix or as surface treatment) are applied to the surface in a targeted manner by traditional techniques. The widening facilitates deep penetration of the additives along the thickness of the fibrous web. The subsequent contraction of the elastic layer induces by entrainment a simultaneous transverse compaction in the fibrous web and helps to incorporate the added substance by creating a pressure in the transverse direction.

If the additive is added immediately before the widening, the subsequent deformation of the fibrous web produces a widening of the interstices between the fibers, so facilitating absorption and distribution of the additive within the fibrous mass.

It should be noted that to achieve a higher treatment efficiency, a pressure can be applied from above, for example by presser rollers, felts, shoe-presses etc., and/or a vacuum can be applied below the elastic belt if this is permeable to fluids. Presser rollers and felts can have a peripheral velocity different from the underlying elastic belt.

The transverse widening and recompaction of the fibrous web 2 with relative additive addition and/or drying can be repeated several times as schematically shown in FIG. 0. In particular, in the initial widening process the fibrous web 2, adhering to the elastic belt 4, is simply stretched transversely, dried and recompacted whereas in the subsequent two treatments, between transverse stretching and release, two different additives are added.

In FIG. 1 a double process of widening and recompaction of the fibrous web 2 is achieved on an elastic conveyor belt 4 extending between two rollers 8 each provided with circumferential cavities at the respective ends into which the elastic belt is forced by pairs of introduction rollers 12. In both cases a presser roller 14 helps to maintain adhesion of the fibrous web to the elastic belt. In particular during the initial transverse widening a first modifier product is added to the fibrous web; a second modifier product is added after release and recompaction, but before the second transverse stretching.

Figure 12:
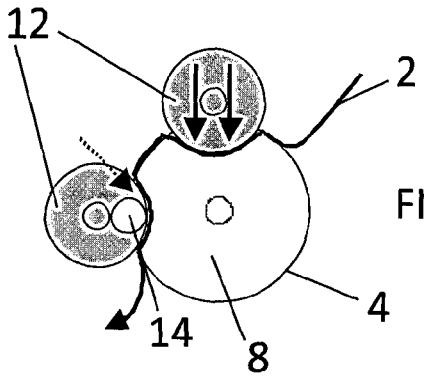
FIG. 12 is a lateral section through a third embodiment thereof.

In FIG. 12 the double process of widening and recompacting the fibrous web 2 is achieved by two pairs of introduction rollers 12 acting in succession on a single roller 8 provided with circumferential cavities and over which the elastic belt 4 is drawn to form a tubular sleeve. In the second widening process a presser roller 14 helps to maintain adhesion of the fibrous web to the elastic belt. In particular during the initial transverse widening, a first modifier product is added to the fibrous web; a second modifier product is added after release and recompaction, but before the second transverse stretching.

FIG. 13 shows an endless belt 2 of fluid-permeable elastic material wrapped about a first roller member 16 provided with two external rollers 18 for supporting the belt. Means for constraining the longitudinal edges of the endless belt 2 to the roller member 16 are also provided, together with extenders 21 able to vary the distance of at least one band of said endless belt from the rotation axis of the roller member, to cause temporary local stretching of the belt in a direction perpendicular to its advancement direction. A vacuum compartment 20 holds the fibrous web adhering to the belt.

Stretching the elastic belt in the system shown in FIG. 13 causes it to undergo both transverse and longitudinal lengthening, leading to compaction in both directions together with the fibrous web, after the elastic belt has returned to its original size.

FIG. 14 shows an endless conveyor belt 2 associated with drive means and with a pair of extender elements 22 acting simultaneously in a direction substantially parallel to the belt surface perpendicular to its advancement direction.

FIG. 15 shows an apparatus comprising a tubular sleeve 24 of elastic material, a pair of discs 26 supporting the tubular sleeve, and a fixed shaft 28 on which the discs 26 are mounted such that their axis is inclinable relative to the axis of said sleeve, the end portions of the shaft 28 extending beyond the discs 26.

Figure 16:
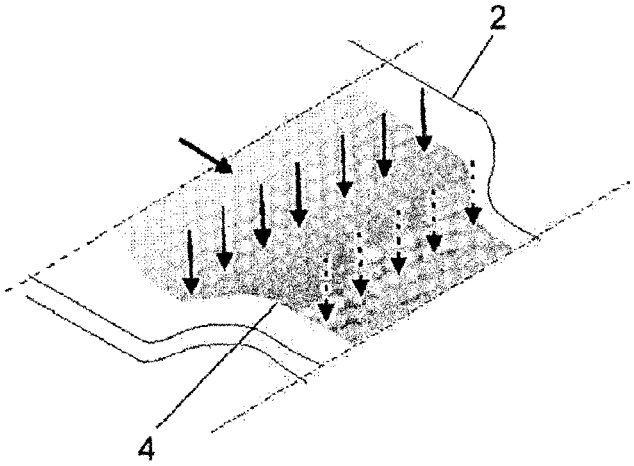
FIG. 16 shows schematically a portion of elastic conveyor belt with fibrous web subjected to additive addition, stretching, and advancement while maintained stretched.

FIG. 16 shows an already extended conveyor belt with the fibrous web resting on it and in the process of receiving additive. The belt is then returned to its original configuration. In this manner a transversely extendable web is obtained.

Figure 17:
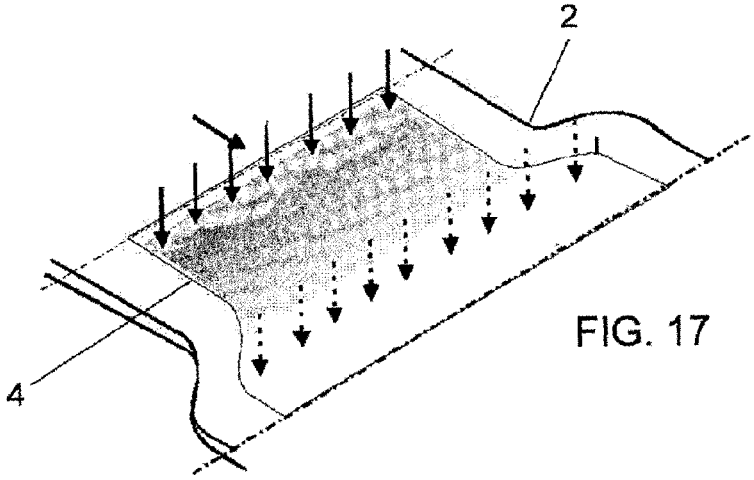
FIG. 17 shows schematically an already stretched portion of elastic conveyor belt with fibrous web which is subjected to additive addition and then released.

FIG. 17 shows a conveyor belt with a fibrous web resting on it and which after being subjected to transverse extension and additive addition is removed from the belt.

This web remains stabilized in its width and can have a width equal to the original width with compensation for the width loss which the drying causes.

FIG. 18 shows a pair of rollers, one of which, 30, is of rubber or other extendable material and is driven at a velocity less than the other roller 32, which is of hard metal material. In some cases the hard roller 32 is provided with a plurality of circumferential surface ribs. In this embodiment, additive addition can take place either by forming in the hard roller a plurality of holes through which to pass the additive or by making the rubber roller dip into a tank containing the additive.

Moreover, in order to facilitate correct transverse stretching of the elastic conveyor belt 4, which given its function must be in continuous contact with support and drive rollers, the sliding of the elastic belt on these conveyor rollers is advantageously favoured by suitable lubricant substances interposed between the two or by suitably varying the belt thickness and/or by suitably convex-shaping the conveyor rollers or by providing these with ball retainers.

By combining the addition of a modifier product with the transverse widening and recompaction of the fibrous web, the additive addition efficiency can be optimized, so limiting effluent production. For example, costly additives such as titanium dioxide can be saved, hence avoiding the production of large quantities of water effluents to be purified, in contrast with what happens when adding it in quantity to the pulp.

Incompatibility between the additives in solution or suspension (for example because of pH incompatibility or because they would form a gel or a precipitate) can be avoided by adding them in different stages. In this manner for example, a gel could be formed directly within the fibrous web by adding two gelling components separately, such as alginate and calcium ions.

This additive addition can consist of spraying, of deposition by rollers, of impregnation with liquid formulations released from a sponge layer forming part of the elastic belt, or other methods known to the expert of the art.

The degree of dryness of the fibrous web is chosen on the basis of the additive to be added, the uniformity of surface distribution, the penetration along the web thickness and/or the final effect to be obtained. In particular, greater control of the degree of surface distribution, including regulated addition, and of the penetration of the additive along the thickness of the fibrous web can be achieved. The additive additions on the two faces of the fibrous web can obviously be different, for example different colors.

By controlling the porosity and the additive distribution along the web thickness, it is possible, for example, to finely regulate the surface sizing of a paper web, to optimize its properties of liquid penetration and of resistance to delamination or to dust, depending on the type of printing for which the paper is intended.

In a similar manner, in tissue paper, finer adjustment is possible of the softening additives which tend to cause a reduction in mechanical strength and to interfere with adhesion to the yankee cylinder and hence with the crinkling process, so reducing their environmental impact.

Deep coloration of the fibrous material can also be obtained by dyes or pigments.

Again, by controlling the distribution of fillers and additives along the thickness together with more controlled removal of moisture, more uniform drying can be obtained, together with a final material less subjected to hygroscopic deformations and loss of planarity.

Additives in powder form are preferably dispersed in water and mixed with binding agents, such as cationic polymers, nanocellulose, polyglycols, acrylic dispersions, styrene-butadiene dispersions, etc.

Said additives can also be activated by administering energy from the outside (heat, UV or visible radiation, microwaves, electron beam, etc.), and provide the required effect only after activation (including external to the paper machine). In particular, the additives can be encapsulated in microcapsules added to the fibrous web and of which the capsule shell can be broken successively by applying pressure or heat, in order to cause release of the additive at the required moment.

The various additives must be able to perform their function and be activated, if necessary, without mutual interference.

The additives to be added can provide properties such as:

porosity control (surface porosity is essential for determining the capacity to filter ink pigments from their carrier and hence for print quality) along the thickness with additives such as:

crystalline microcellulose, nanocellulose, mineral fillers generated in situ by precipitation (such as precipitated CaCO3 to which a calcium bicarbonate solution is added and water and carbon dioxide removed by heating; the solution can contain binders and/or substances able to influence the morphology of the precipitated $CaCO_3$ crystals),
polyalkyleneglycols (porosity increase; see WO 08/131793)
additives for favouring drainage under pressure, for example those reported in U.S. Pat. No. 7,556,714,
barrier towards oxygen and/or water vapor
proteins (glutins, milk serum derivatives)
vinylidene chloride copolymers in accordance with CA 711208,
nanocellulose
opacity
mineral fillers generated in situ by precipitation,
kaolin
mica
antigrease
starch
nanocellulose
alginates
carboxy methyl cellulose
polyvinylalcohol
sizing
starch
softness
non-ionic surfactants
cation is surfactants
anionic surfactants
natural fats
vegetable oils
fatty alcohols
cationic polymers
silicone microemulsions
perfume/emollient properties
perfumes also in microcapsules
aloe also in microcapsules
essential oils also in microcapsules
dust control, resistance to delamination, in particular during the printing process
starch
nanocellulose
carboxymethylcellulose
water repellence (including for capacitor insulating papers easily soakable in dielectric oils or resins)
waxes, including natural waxes, preferably in dispersion
colophony
hydrophilicity
polyalkyleneglycols
ink adhesion
titanium acetyl acetonate
silanes
gum Arabic
dextrins
alum
antiadherence
silicone resins
adhesive curing rate, particularly polyurethane based
zinc stearate
caprolactam
N-acylureas
tertiary amines
color
pigments in dispersion, particularly titanium dioxide for degree of whiteness
pigments based on optical interference generated by nano layers of polyelectrolytes, such as nano cellulose and polyethylene imine
colorants, including thermal, electro or photo chromic
voluminosity
microcapsules containing expanding agents activatable by heating
nanocellulose based foams
chemical expanding agents
sodium bicarbonate and weak acids possibly added separately in successive stages
possible heating by induction
preferably biodegradable susceptors, such as some of those described in U.S. Pat. No. 6,348,679, able to convert electromagnetic energy at radio frequency or microwaves into heat.
In particular the susceptors can be added in mixture with nanocellulose such as to be able to achieve effective drying of this latter.
rigidity and tensile strength (dry and/or wet)
starch
nanocellulose
acrylic resins cross-linkable by photo initiators and UV light
melamine resins cross-linkable by heat
polyamide resins modified with epichlorohydrin
In particular, by controlling the degree of additive penetration it is possible to increase the tensile strength in papers formed from tubular rigid fibres while still maintaining good characteristics of opacity and tearing resistance
oxygen scavengers
encapsulated substances to function at the required moment, such as ferrous salts
electrical conductivity
carbon fibers
antibacterials
carbon silver salts
silver nanoparticles
titanium dioxide
quaternary ammonium salts (or ammonium ions associated with nano cellulose or microcellulose)
chitosan
bacteriocins
various natural extracts (from tea, nutmeg, grapefruit, etc.).

By means of the successive fibrous web recompaction and widening processes, the final degree of fiber cohesion can be controlled as a function of the residual moisture. This can also be useful in the production of cellulose sheets as semi-finished products intended for papermaking plants to produce the pulp by means of redispersion.

Finally, depending on the use for which the product is intended, the method of the invention can be combined with traditional treatment methods for the final fibrous web, and in particular with coupling methods and/or methods for stretching coupled webs and/or production methods for extensible material webs, such as those described for example in EP 772522, in EP 824619, in EP 876536, in EP 946353, in U.S. Pat. No. 2,624,245 or in U.S. Pat. No. 7,918,966.

From the aforegoing it is apparent that the method according to the invention presents the following advantages:

a greater flexibility and efficiency in adding additives which previously had to be added in bulk, a greater flexibility and efficiency in adding surface additives, new effects by the possible interaction of both.

What is claimed is:

1. A method of modifying physical and/or chemical characteristics of a web of paper material, comprising:

causing a web (2) of paper material, having a dry content between 1% and 90%, to adhere to an endless conveyor belt (4) of elastic material;

subjecting said conveyor belt and said web to at least one localized temporary dimensional variation, thereby causing at least one localized temporary dimensional variation of said web;

introducing at least one additive between fibers of said web while said web adheres to said belt before or during said localized temporary dimensional variation thereof, thereby causing said additive to be penetrate into a thickness of said web after said localized temporary dimensional variation of said web; and returning said conveyor belt to its original dimensions while always maintaining said web of paper material adhering to said conveyor belt.

2. The method as claimed in claim 1, further comprising the step of removing moisture from the web adhering to said conveyor belt between the step of dimensionally varying said conveyor belt (4) and returning the conveyor belt to its original dimension.

3. The method as claimed in claim 1, further comprising the step of using a fluid-permeable conveyor belt.

4. An apparatus for modifying physical and/or chemical characteristics of a web of paper material, comprising:

a conveyor belt (4) of elastic material;

a member (12) configured to dispose a web (2) of fibrous material having a dry content between 1% and 90% on said conveyor belt (4);

a system configured to cause at least one temporary localized dimensional variation of said conveyor belt and of said web adhering to said conveyor belt, said member maintaining said web adhering to said conveyor belt during said temporary localized dimensional variation; and a system configured to introduce at least one additive between fibers of said web before or during said localized dimensional variation of said elastic belt, wherein said conveyor belt is wrapped about a first roller member provided with at least two external rollers defining at least one circumferential cavity (10) and with a system configured to constrain longitudinal edges of said conveyor belt to said external rollers, the system configured to cause the temporary local dimensional variation comprising a second roller member (12) brought to interfere with said first roller member to cause that surface of said belt not constrained to said external rollers to enter said cavity further comprising a system configured to return the conveyor belt to its original configuration.

5. The apparatus as claimed in claim 4, wherein said conveyor belt is formed of a fluid permeable material and is associated with a system which, at least in a part of a length of said belt to which said web adheres, generate a gas flow passing through said conveyor belt.

6. The apparatus as claimed in claim 4, further comprising a system configured to remove water from said fibrous web adhering to the conveyor belt.

7. The apparatus as claimed in claim 4, further comprising at least one pair of extender elements (22) acting simultaneously on the conveyor belt in a direction substantially parallel to an advancement direction of the conveyor belt.

8. An apparatus for modifying physical and/or chemical characteristics of a web of paper material, comprising:

a conveyor belt (4) of elastic material;

a member (12) configured to dispose a web (2) of fibrous material having a dry content between 1% and 90% on said conveyor belt (4);

a system configured to cause at least one temporary localized dimensional variation of said conveyor belt and of said web adhering to said conveyor belt, said member maintaining said web adhering to said conveyor belt during said temporary localized dimensional variation; and a system configured to introduce at least one additive between fibers of said web before or during said localized dimensional variation of said elastic belt, wherein the conveyor belt comprises an endless belt (2) of fluid-permeable elastic material wrapped about a first roller member (16) provided with at least two external rollers (18) for supporting said belt, and with a system (20) configured to vary a distance of at least one band of said endless belt from a rotation axis of said first roller member, in order to cause a temporary local stretching of the endless belt in a direction perpendicular to its advancement direction further comprising a system configured to return the conveyor belt to its original configuration.

9. An apparatus for modifying physical and/or chemical characteristics of a web of paper material, comprising:

a conveyor belt (4) of elastic material;

a member (12) configured to dispose a web (2) of fibrous material having a dry content between 1% and 90% on said conveyor belt (4);

a system configured to cause at least one temporary localized dimensional variation of said conveyor belt and of said web adhering to said conveyor belt, said member maintaining said web adhering to said conveyor belt during said temporary localized dimensional variation, said system comprising a first and a second roller, the first roller (30) being of rubber or another extendable material and being driven at a velocity less than the second roller (32), which is of a hard metal material; and a system configured to introduce at least one additive between fibers of said web before or during said localized dimensional variation of said elastic belt further comprising a system configured to return the conveyor belt to its original configuration.

* * * * *